US007217084B2

(12) United States Patent
Yu et al.

(10) Patent No.: US 7,217,084 B2
(45) Date of Patent: May 15, 2007

(54) AUTOMOTIVE FUEL PUMP WITH PRESSURE BALANCED IMPELLER

(75) Inventors: DeQuan Yu, Ann Arbor, MI (US); Paul E. Fisher, Brighton, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 11/305,901

(22) Filed: Dec. 19, 2005

(65) Prior Publication Data

US 2006/0104804 A1 May 18, 2006

Related U.S. Application Data

(63) Continuation-in-part of application No. 10/842,685, filed on May 10, 2004, now Pat. No. 7,008,174.

(51) Int. Cl.
*F01D 1/12* (2006.01)

(52) U.S. Cl. ..... 415/55.1; 415/55.2

(58) Field of Classification Search ..... 415/55.1–7, 415/232; 417/369, 423.1
See application file for complete search history.

(56) References Cited

U.S. PATENT DOCUMENTS 5,472,321 A 12/1995 Radermacher
6,019,570 A 2/2000 Talaski
6,102,653 A * 8/2000 Marx ..... 415/55.1
6,299,406 B1 10/2001 Yu et al.
6,604,905 B1 8/2003 Yu et al.
6,669,437 B2 * 12/2003 Yu et al. ..... 415/55.1
6,739,844 B1 5/2004 Yu et al.

* cited by examiner

*Primary Examiner*—Igor Kershteyn
(74) *Attorney, Agent, or Firm*—Gregory P. Brown; MacMillan, Sobanski & Todd, LLC

(57) ABSTRACT

A rotary fuel pump employs pressure balancing features on the non-vaned side of the impeller to provide localized application of fluid forces so that the impeller is more precisely balanced within the pumping chamber. A generally disc-shaped impeller body has an impeller with a body-side surface and a cover-side surface. The cover-side surface defines an impeller flow channel extending circumferentially around the impeller. The impeller includes a plurality of vanes positioned at least partially within the impeller flow channel. The body-side surface has a plurality of discontinuous undercut regions each coaxially aligned with at least a portion of the impeller flow channel. The impeller has a plurality of apertures wherein each aperture connects the impeller flow channel with a respective undercut region, whereby pressure forces against the impeller from the fuel are substantially balanced in the axial direction.

12 Claims, 6 Drawing Sheets

AUTOMOTIVE FUEL PUMP WITH PRESSURE BALANCED IMPELLER

CROSS REFERENCE TO RELATED APPLICATIONS

This application is a continuation-in-part of U.S. application Ser. No. 10/842,685, filed May 10, 2004, now U.S Pat. No. 7,008,174, entitled "Fuel Pump Having Single Sided Impeller" which is incorporated herein in its entirety.

STATEMENT REGARDING FEDERALLY SPONSORED RESEARCH

Not Applicable.

BACKGROUND OF THE INVENTION

The present invention relates in general to automotive fuel pumps, and, more specifically, to regenerative fuel pumps having a rotary impeller.

Regenerative fuel pumps are widely used in automotive applications. They generally include an impeller rotating on a shaft and positioned within a pumping chamber in the pump. The clearance between the opposing axial sides of the impeller and the corresponding walls of the pumping chamber must be closely regulated to permit the pump to handle fuel at relatively high pressures (i.e. greater than about 2 bar). It has not been possible to maintain a precisely centered position within the pumping chamber when the impeller is fixedly mounted at a particular axial position on the shaft. This is because wearing of the shaft support structure causes the shaft to shift axially over time. Therefore, the impeller is slidably mounted on the shaft to allow axial translation.

The impellers typically comprise double-sided impellers, meaning the impellers include vanes on each opposing side for pressurizing fuel on both sides of the impeller. Due to the pressurization taking place on both sides, the impellers are relatively well balanced axially to maintain the necessary clearance from each side of the pumping chamber.

One drawback of fuel pumps with double-sided impellers is that their wet circle index is relatively high, typically 1.7 or greater. The wet circle index characterizes the pump boundary layer frictional losses and can be defined as the wet circle length versus the flow channel cross-sectional area. The wet circle length is the distance along the perimeter of the flow channel (e.g., circumference of a round flow channel) formed by the impeller and the opposing structures (e.g., body and cover structures) of the pumping chamber.

A single-sided impeller (i.e., an impeller having vanes and an impeller flow channel on only one side) can achieve a decreased wet circle index relative to a double-sided impeller since the length of the flow channel can be cut in half. If the flow channel cross-sectional area is kept the same, then the frictional losses are also cut in half. A drawback of using single-sided impellers has been that they were not balanced because the fuel pressure acting on the vaned side of the impeller displaced it off center in the pumping chamber.

Parent application U.S. Ser. No. 10/842,685 teaches a single-sided impeller having specially added areas that are exposed to fuel on one side or the other of the impeller, the added areas being sized to provide a body-side force approximately equal to a cover-side force. Consequently, the impeller is balance on the shaft and maintains robust axial clearances (i.e., is centered in the pumping chamber) so that the pump operates at high efficiency. The added areas are created by forming additional channels in the internal surfaces of cover and body member defining the pumping chamber in a manner that deploys the necessary forces to balance the impeller.

The pressure provided by an additional channel is determined by the pressure at the point where the channel emerges from a flow channel or passageway. This particular pressure can then be applied against corresponding surfaces of the impeller to obtain an approximate balance. Since the pressure to be balanced along the flow channel varies, however, it can be difficult to obtain a precise balance. The shape, size, and position of the additional channels in the internal surface of the pumping chamber can be empirically determined by trial and error using computer simulations or actual testing. Such a process is time consuming and results in high development costs. Furthermore, different vehicle applications specify unique and different fuel pressures or other pump parameters and it is not possible to easily modify an existing design layout that provides balance in one vehicle application into a similar layout for a different vehicle application. Thus, it would be desirable to provide for improved pressure balancing performance for a single-sided impeller that can be developed in a shorter time and at lower cost.

SUMMARY OF THE INVENTION

The present invention employs pressure balancing features on the non-vaned side of the impeller to provide localized application of fluid forces so that the impeller is more precisely balanced while using a simple and straightforward development process.

In one aspect of the invention, a fuel pump is provided for pressurizing fuel to be delivered to an engine of the motor vehicle. The fuel pump comprises a housing and an electric motor mounted in the housing and having a shaft defining an axial direction. A cover is attached to the housing having an internal cover surface defining a cover flow channel extending circumferentially around the internal cover surface. The cover includes an inlet for coupling lower pressure fuel to the cover flow channel at an inlet end, the cover flow channel further including an outlet end providing higher pressure fuel. A body member is coupled to the cover and has an internal body surface. The body member and the cover cooperatively define a pumping chamber between the internal body surface and the internal cover surface. The internal body surface defines an outlet passageway to receive the higher pressure fuel for delivery to the engine. An impeller is mounted to the shaft for rotation therewith and for axial translation along the shaft within the pumping chamber, the impeller having a body-side surface and a cover-side surface. The cover-side surface defines an impeller flow channel extending circumferentially around the impeller juxtaposed with at least a major portion of the cover flow channel. The impeller includes a plurality of vanes positioned at least partially within the impeller flow channel. The body-side surface has a plurality of discontinuous undercut regions each coaxially aligned with at least a portion of the impeller flow channel. The impeller has a plurality of apertures wherein each aperture connects the impeller flow channel with a respective undercut region, whereby pressure forces against the impeller from the fuel are substantially balanced in the axial direction.

DETAILED DESCRIPTION OF PREFERRED EMBODIMENTS

Figure 1:
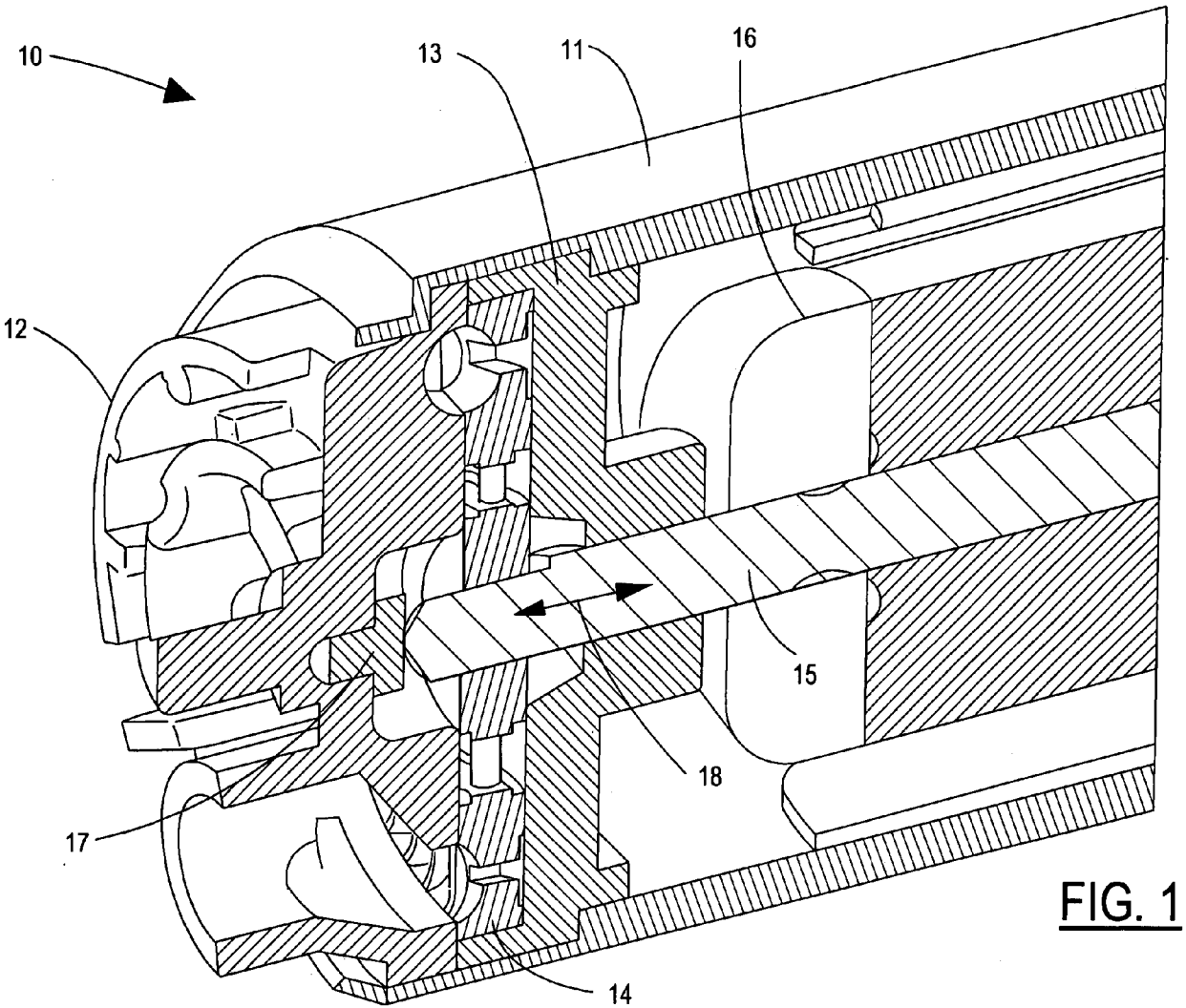
FIG. 1 is a cross-sectional, perspective view of one end of a fuel pump containing the pumping chamber.

Referring to FIG. 1, a fuel pump 10 comprises a housing 11 containing a cover 12 and a body member 13. The enclosed space between cover 12 and body member 13 provides a pumping chamber wherein an impeller 14 is mounted for rotation with a motor shaft 15. Shaft 15 is connected to a motor armature 16 and is retained at one end by a thrust bearing 17. Impeller 14 is keyed upon shaft 15 in order to rotate therewith while allowing impeller 14 to translate along an axial direction 18 so that it can stay centered in the pumping chamber. Thus, when thrust bearing 17 wears during the lifetime of the fuel pump causing shaft 15 to shift in axial direction 18, impeller 14 will not become bound against a side of the pumping chamber as it would if it were locked in a fixed axial position on shaft 15.

Impeller 14 of the present invention is a single sided impeller to reduce the wet circle index from about 1.8 to about 1.1, thereby reducing friction losses and increasing the hydraulic efficiency of the pump by about 25%–35%. Furthermore, impeller 14 is axially free floating while maintaining an axial clearance that is sufficient to handle fuels at higher pressure, typically about 2 bar or greater.

Figure 2:
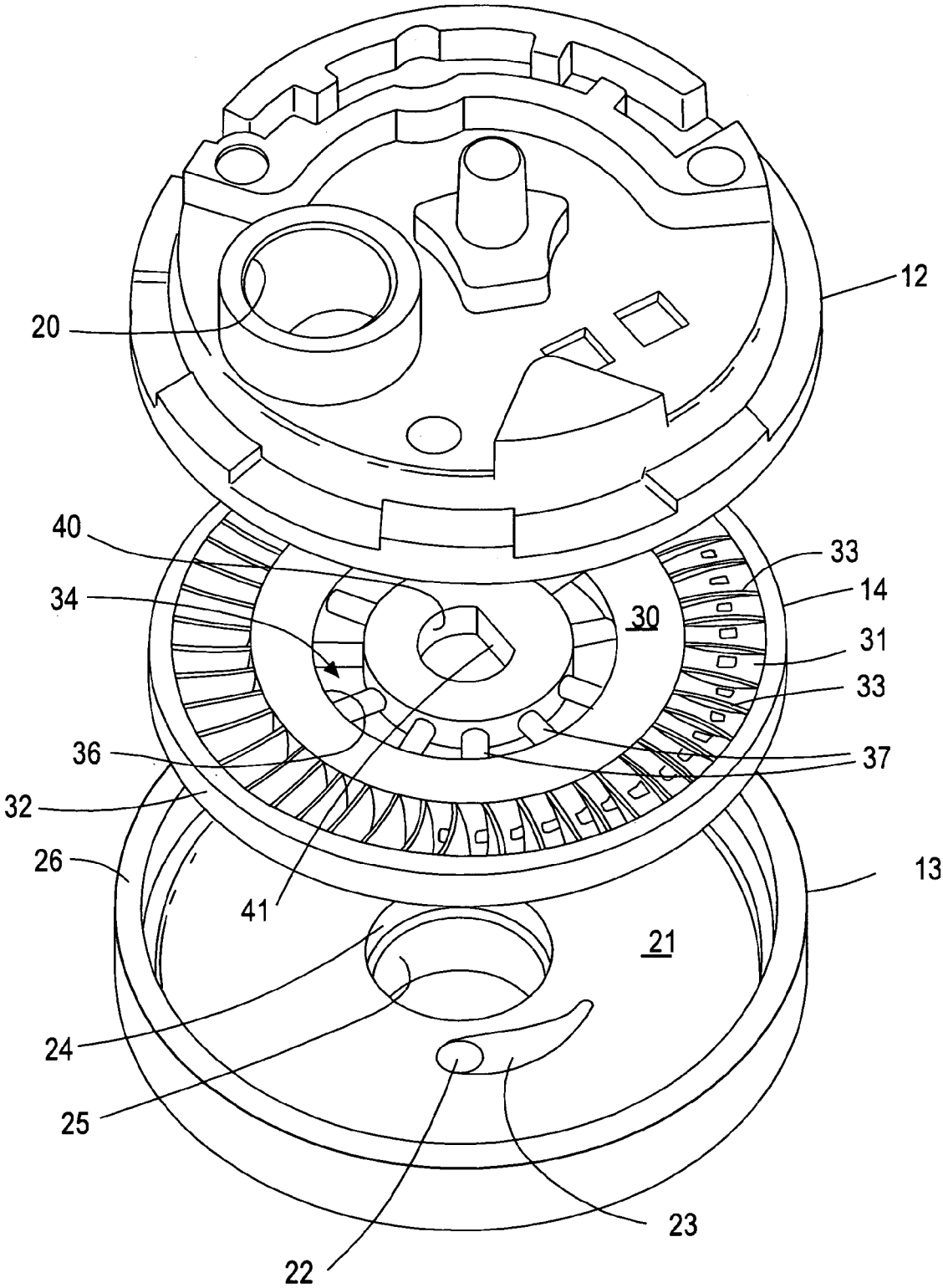
FIG. 2 is an exploded view of the cover, impeller, and body member of FIG. 1.

Referring to FIG. 2, cover 12 includes a fuel inlet 20 for receiving lower pressure fuel from a fuel tank. Body member 13 includes an internal body surface 21 axially facing towards impeller 14. Body member 13 defines an outlet 22 which cooperates with a recess 23 to guide higher pressure fuel toward outlet 22. Body member 13 also defines a central aperture 24 and a bearing 25 through which shaft 15 extends for connection with impeller 14. Body member 13 includes a peripheral rim 26 to further define the pumping chamber along with internal body surface 21.

Figure 3:
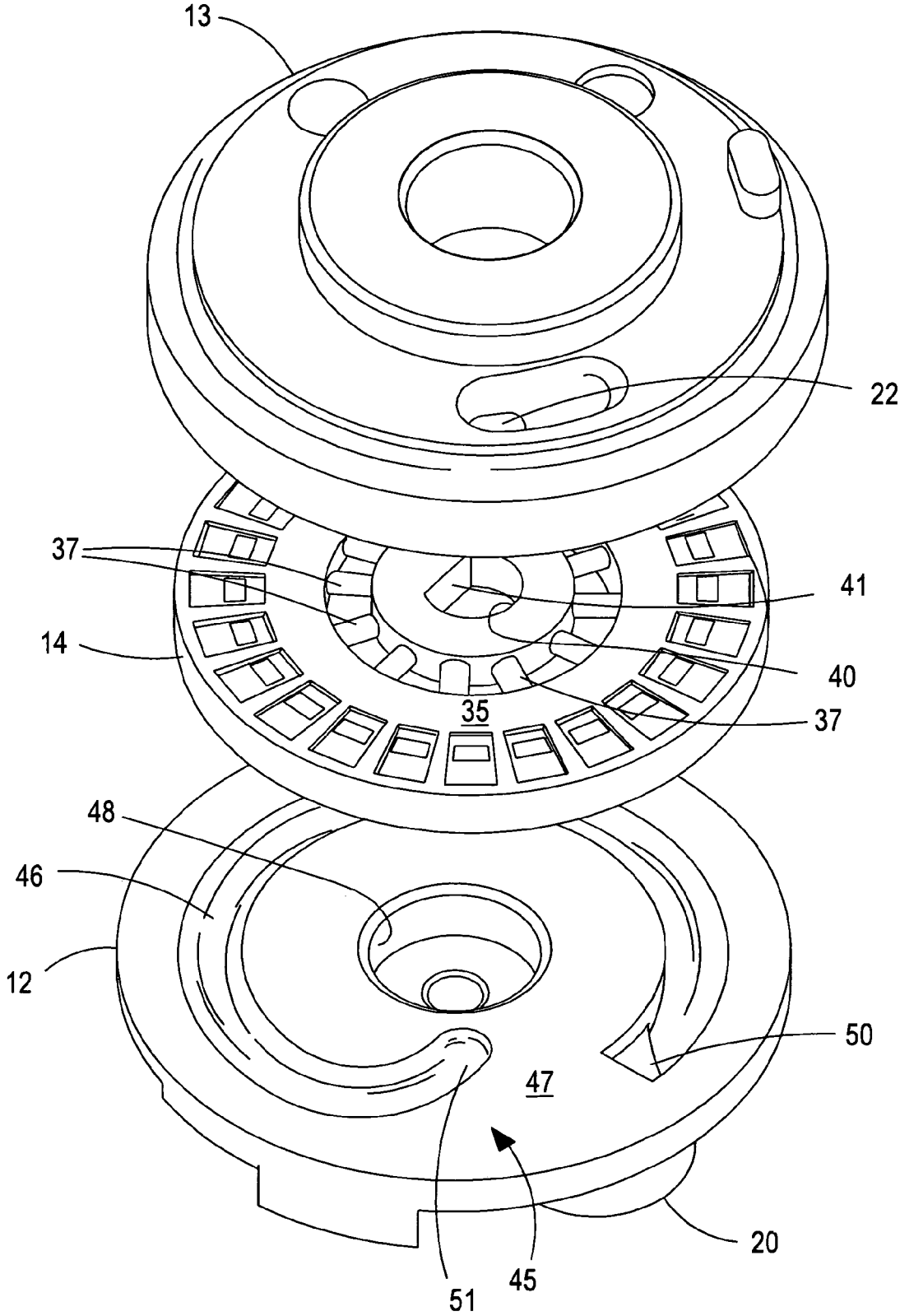
FIG. 3 is an exploded view of the cover, impeller, and body member of FIG. 2 showing the opposite faces.

FIG. 2 shows a cover-side surface 30 of impeller 14 which defines an impeller flow channel 31. Impeller flow channel 31 extends circumferentially around impeller 14 and is proximal to an outer peripheral surface 32 of impeller 14. Mounted within impeller flow channel 31 are a plurality of vanes 33 which are used to pressurize the fuel, as known in the art. An impeller flow passageway 34 extends through impeller 14 from the cover-side surface 30 to a body-side surface 35 (FIG. 3). Flow passageway 34 is defined by a plurality of circumferentially spaced apertures 36 separated by a plurality of spokes 37 each having a circular cross-section to facilitate fluid flow. It will be recognized by those skilled in the art that spokes 37 can have other cross-sectional shapes such as oval, flat, curved, or vane-shaped which can vary along the length of each spoke 37. Non-circular or vane-shape spokes 37 could supplement the pumping action of pump 10. Impeller 14 also includes a central aperture 40 including a flat 41 for receiving shaft 15.

The opposite sides of cover 12, body member 13, and impeller 14 are shown in exploded view in FIG. 3. Cover 12 includes an internal cover surface 45 facing axially toward impeller 14 and defining a cover flow channel 46 extending circumferentially around cover 12. Cover-flow channel 46 is radially aligned with impeller flow channel 31 and vanes 33 for pressurizing fluid therein. Cover-flow channel 46 extends around cover 12 about 330°, thereby leaving a strip area 47 between the ends of cover-flow channel 46. Cover-flow channel 46 has an inlet end 50 receiving lower pressure fuel from inlet 20 and an outlet end 51 that provides higher pressure fuel to the impeller flow passageway 34. Internal cover surface 45 also defines a recess 48 which is sized to receive shaft 15 and thrust button 17.

As can be recognized in FIG. 3, impeller 14 has a body side surface 35 which does not include any vanes or flow channels (i.e., impeller 14 is single sided). Body-side surface 35 includes a plurality of undercut regions and apertures as will be described below.

Figure 4:
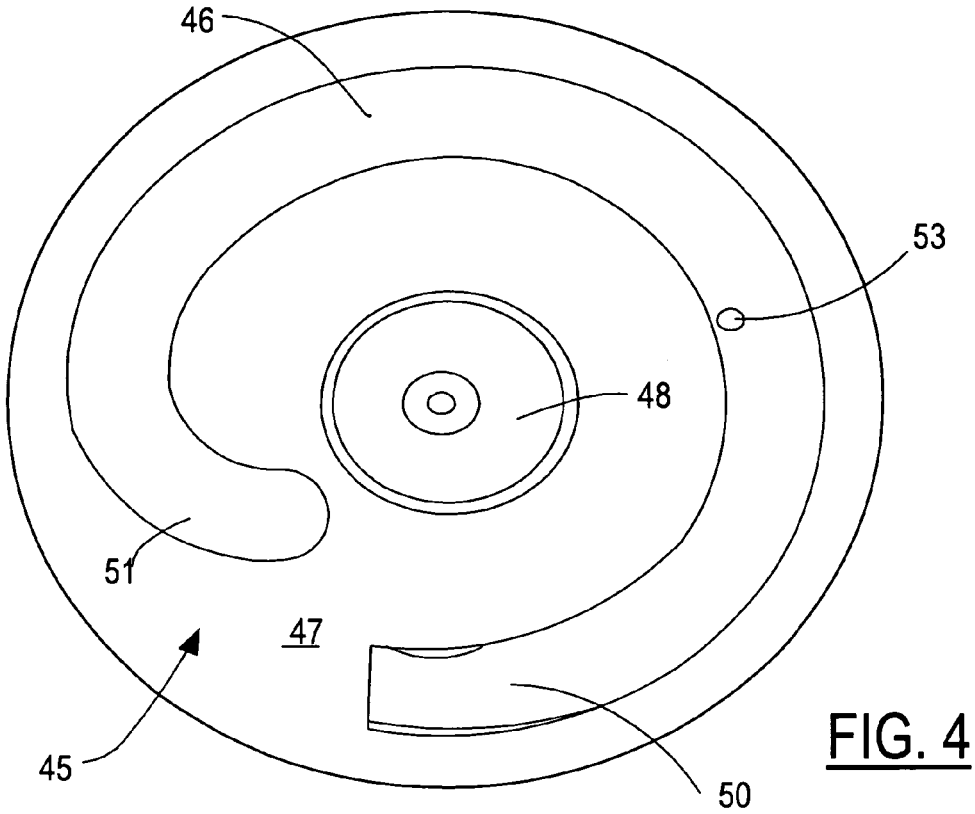
FIG. 4 is a plan view showing a cover flow channel in an internal cover surface.

FIG. 4 shows an enlarged plan view of internal cover surface 45. It can be seen that outlet end 51 curves radially inward to guide high pressure fuel toward the impeller flow passageway so that the pressurized fuel can cross the impeller into outlet 22 of body member 13. Additionally, cover flow channel 46 includes a vapor vent hole 53 which is utilized to vent fuel vapor bubbles out of pump 10.

Figure 5:
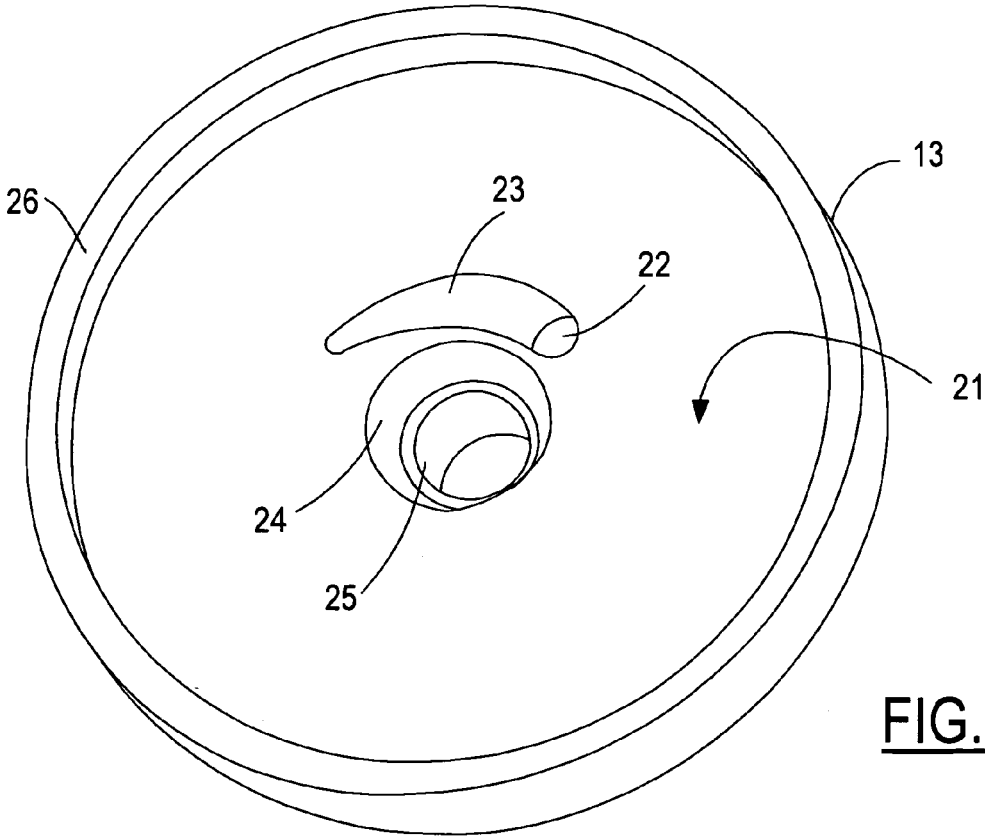
FIG. 5 is a plan view showing an outlet passageway in an internal body surface.

FIG. 5 shows internal body surface 21 in its entirety. In this preferred embodiment, it is smooth other than recess 23 and outlet 22 which are radially aligned with impeller flow passageway 34 allowing high pressure fuel to exit the pumping chamber to pass through the remainder of pump 10 and out to the vehicle engine.

Figure 6:
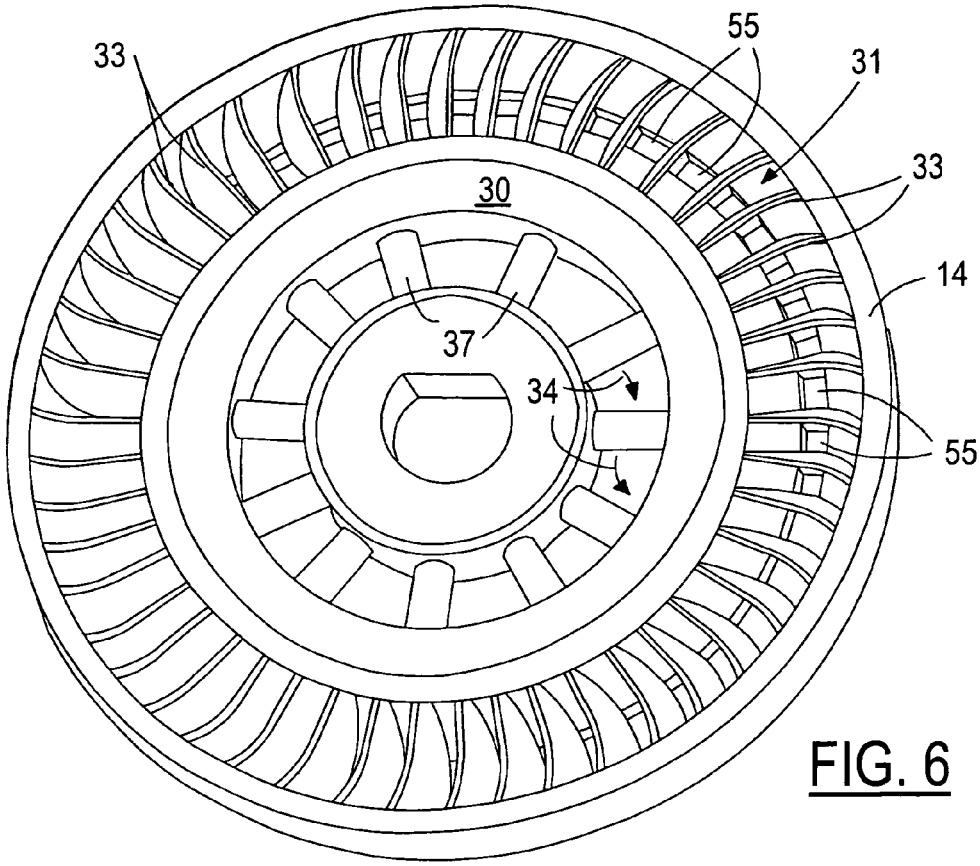
FIG. 6 is a perspective view of a cover-facing side of the impeller of FIG. 1.

The cover-side surface of impeller 14 is shown in greater detail in FIG. 6. Circumferential impeller flow channel 31 is divided by a plurality of vanes 33 which may have any appropriate profile for accelerating fuel in the flow channel as is known in the art. Between each respective pair of vanes, a respective aperture locally couples the impeller flow channel 31 to the body side surface. Thus, the body-side surface is exposed to a source of pressure which is substantially equal to the pressure acting upon the cover-side surface at multiple points around the circumference of impeller 14.

Figure 7:
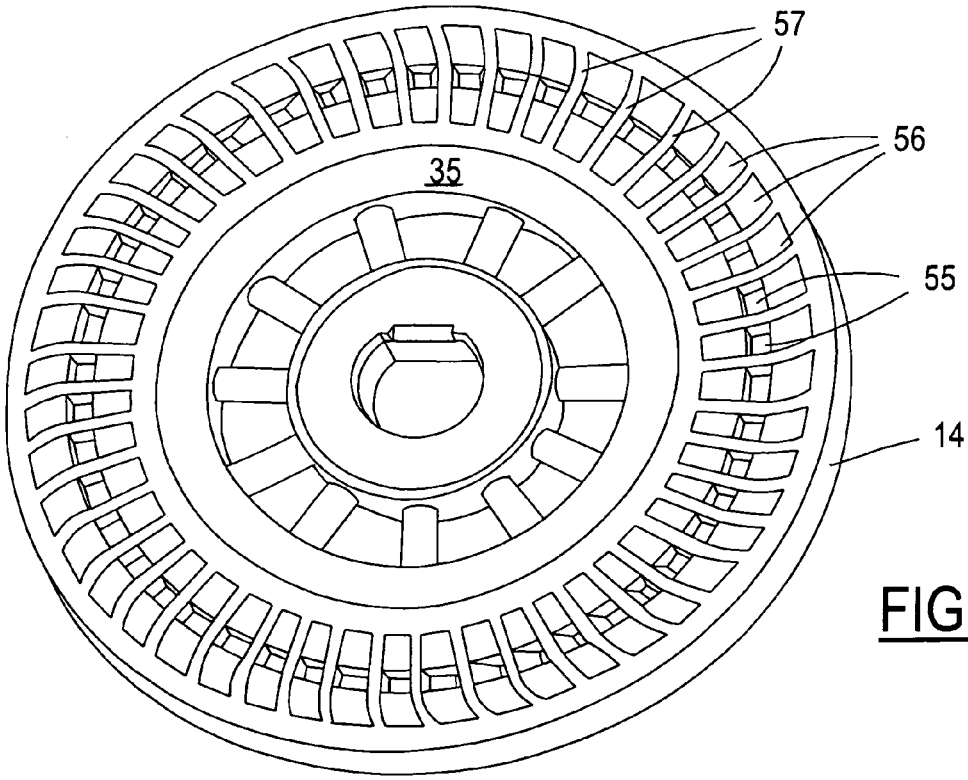
FIG. 7 is a perspective view of a body-facing side of the impeller of FIG. 1.

FIG. 7 shows the body-side surface 35 including a plurality of discontinuous undercut regions 56 communicating with each respective aperture 55. Undercut regions 56 do not connect with one another because any fuel flow between regions would reduce pumping efficiency (by providing a short circuit path across a corresponding vane). Instead, rib portions 57 of body-side surface 35 are left intact between respective undercut regions 56.

Figure 8:
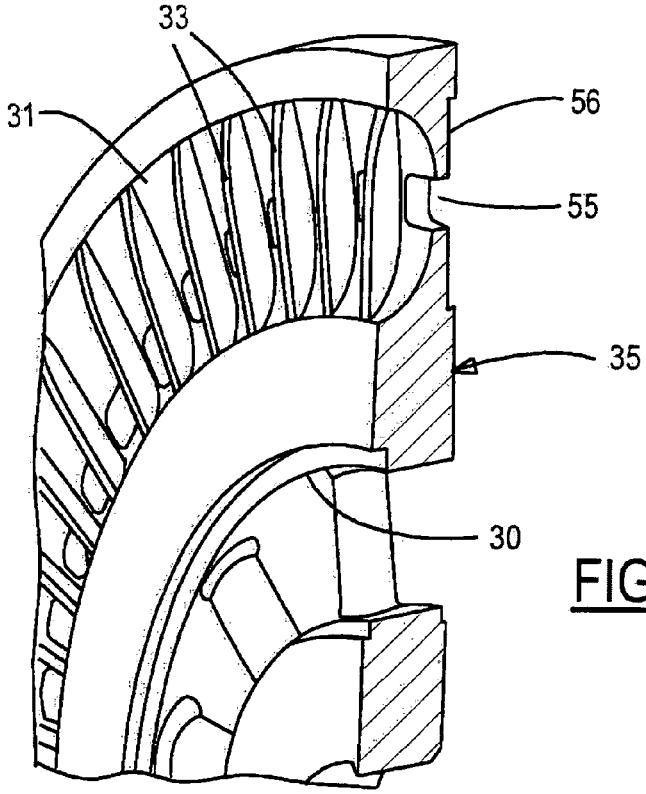
FIG. 8 is a perspective, cross-sectional view showing a portion of the cover-side of the impeller in greater detail.

Fuel entering each undercut region via the respective aperture applies a pressure against the impeller over the corresponding area of the undercut regions, whereby the total pressure acting on the impeller may be balanced. Discontinuous undercut regions 56 may typically be substantially overlapping with corresponding portions of the impeller flow channel between each respective pair of vanes. Preferably, at least a portion of each undercut region 56 is coaxially aligned with the impeller flow channel. As shown in FIG. 8, undercut regions 56 may be exactly overlapping axially with impeller flow channel 31. More or less area of the undercut regions may be desirable depending upon other characteristics of a particular impeller and pump in order to provide greater or lesser magnitudes of force against the impeller. Regions 56 may also be radially offset from impeller flow channel 31 if desired. Although the vanes, apertures, and undercut regions are shown with a one-to-one correspondence, a smaller number of undercut regions or apertures can be used while achieving the same beneficial results. Since the balancing forces are obtained locally from within the impeller flow channel along its circumference, the balancing forces vary in response to the way pressure against the impeller flow channel varies. Consequently, a well balanced impeller can be obtained over all pump operating conditions in a simple and straightforward manner without requiring complicated structures or a long and costly development process.

Figure 9:
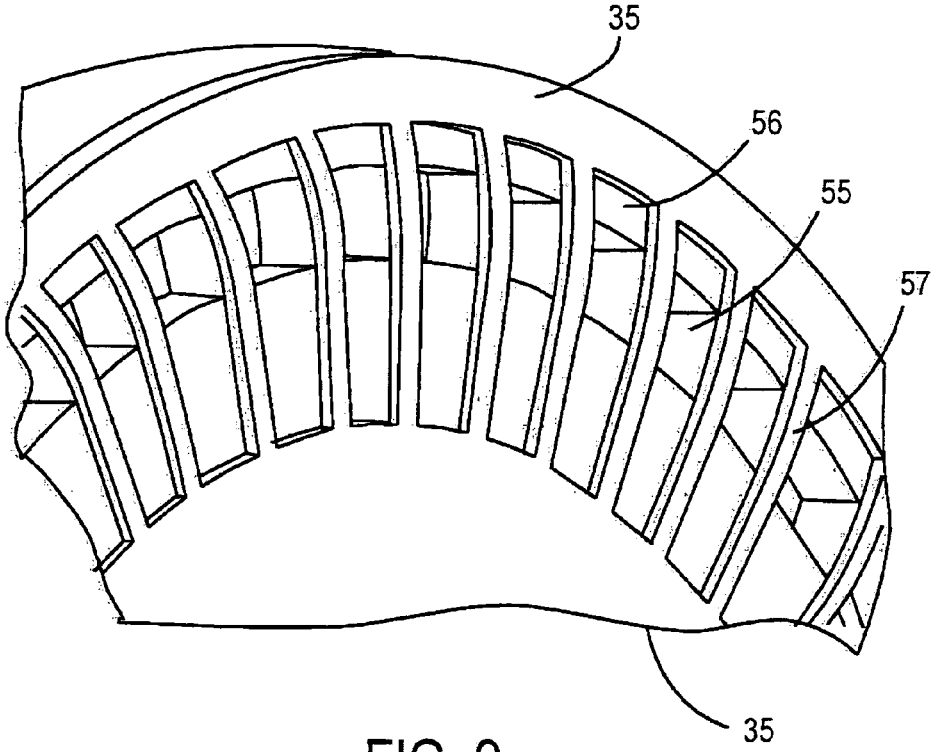
FIG. 9 is a perspective view showing undercut regions of the body-side of the impeller in greater detail.

As shown in FIG. 9, ribs 57 are coplanar with surface 35 to avoid fuel leakage between apertures 55. Therefore, successive apertures 55 are sufficiently isolated to maintain the necessary output pressure of the pump.

What is claimed is:

1. A fuel pump for a motor vehicle for pressurizing fuel to be delivered to an engine of said motor vehicle, said fuel pump comprising:

a housing;

an electric motor mounted in said housing and having a shaft defining an axial direction;

a cover attached to said housing and having an internal cover surface defining a cover flow channel extending circumferentially around said internal cover surface, said cover including an inlet for coupling lower pressure fuel to said cover flow channel at an inlet end, said cover flow channel further including an outlet end providing higher pressure fuel;

a body member coupled to said cover and having an internal body surface, said body member and said cover cooperatively defining a pumping chamber between said internal body surface and said internal cover surface, said internal body surface defining an outlet passageway to receive said higher pressure fuel for delivery to said engine; and a single-sided impeller mounted to said shaft for rotation therewith and for axial translation along said shaft within said pumping chamber, said single-sided impeller having a body-side surface and a cover-side surface, said cover-side surface defining an impeller flow channel extending circumferentially around said single-sided impeller juxtaposed with at least a major portion of said cover flow channel, said single-sided impeller including a plurality of vanes positioned at least partially within said impeller flow channel, said body-side surface having a plurality of discontinuous undercut regions each coaxially aligned with at least a portion of said impeller flow channel, said single-sided impeller having a plurality of apertures wherein each aperture connects said impeller flow channel with a respective undercut region, whereby pressure forces against said single-sided impeller from said fuel are substantially balanced in said axial direction.

2. The fuel pump of claim 1 wherein said single-sided impeller defines a flow passageway extending through said single-sided impeller for coupling said higher pressure fuel from said outlet end of said cover flow channel to said outlet passageway of said body member.

3. The fuel pump of claim 1 wherein each of said apertures is located between a respective pair of vanes.

4. The fuel pump of claim 1 wherein each undercut region substantially overlaps with a corresponding portion of said impeller flow channel between a respective pair of vanes.

5. The fuel pump of claim 4 wherein said body-side surface provides a plurality of ribs, each rib being located between a respective pair of undercut regions substantially preventing fuel flow therebetween.

6. The fuel pump of claim 1 wherein said outlet end of said cover flow channel extends radially inwardly for fluid communication with said flow passageway of said single-sided impeller.

7. A single-sided impeller for a motor vehicle fuel pump, wherein said fuel pump Includes a driven shaft for receiving said single-sided impeller and a pumping chamber defined by a cover and a body member, said single-sided impeller comprising:

a generally disc-shaped single-sided impeller body having a central aperture for mounting to said driven shaft for rotation therewith and for axial translation along said driven shaft within said pumping chamber, said single-sided impeller having a body-side surface and a cover-side surface, said cover-side surface defining an impeller flow channel extending circumferentially around said single-sided impeller, said single-sided impeller including a plurality of vanes positioned at least partially within said impeller flow channel, said body-side surface having a plurality of discontinuous undercut regions each coaxially aligned with at least a portion of said impeller flow channel, said single-sided impeller having a plurality of apertures wherein each aperture connects said impeller flow channel with a respective undercut region, whereby pressure forces against said single-sided impeller from said fuel are substantially balanced in said axial direction.

8. The single-sided impeller of claim 7 wherein said single-sided impeller defines a flow passageway radially spaced from said impeller flow channel for passing pressurized fuel across said pumping chamber.

9. The single-sided impeller of claim 7 wherein each of said apertures is located between a respective pair of vanes.

10. The single-sided impeller of claim 7 wherein each undercut region substantially overlaps with a corresponding portion of said impeller flow channel between a respective pair of vanes.

11. The single-sided impeller of claim 10 wherein said body-side surface provides a plurality of ribs, each rib being located between a respective pair of undercut regions substantially preventing fuel flow therebetween.

12. A method of balancing pressure against a single-sided impeller within a pumping chamber of a motor vehicle fuel pump, wherein said single-sided impeller is mounted on said shaft for rotation therewith and for axial translation thereon, said method comprising the steps of:

providing fuel to an inlet of said pumping chamber;

rotating said shaft;

accelerating said fuel along an impeller flow channel in response to a plurality of vanes positioned within said impeller flow channel, said impeller flow channel being formed in a cover-side of said single-sided impeller, whereby said fuel generates a pressure against said impeller flow channel that varies along its circumference;

coupling fuel between pairs of vanes within said impeller flow channel through respective apertures across said single-sided impeller to respective undercut regions in a body-side of said single-sided impeller, whereby a balancing pressure is generated against said undercut regions that vary in response to the way said pressure against said impeller flow channel varies.

* * * * *